US005501346A

United States Patent [19]

Wimmer

[11] Patent Number: 5,501,346

[45] Date of Patent: Mar. 26, 1996

[54] MULTISTAGE TTELESCOPE BOOM

[75] Inventor: Eckhard Wimmer, Hallein, Austria

[73] Assignee: Palfinger Aktiengesellschaft, Bergheim/Salzburg, Austria

[21] Appl. No.: 370,458

[22] Filed: Jan. 9, 1995

Related U.S. Application Data

[63] Continuation of Ser. No. 81,293, filed as PCT/AT92/00144, Nov. 10, 1992, abandoned.

[30] Foreign Application Priority Data

Nov. 11, 1991 [AT] Austria ..... 2224/91

[51] Int. Cl.[6] ..... B66C 23/04

[52] U.S. Cl. ..... 212/349; 212/231

[58] Field of Search ..... 212/268, 231, 212/349; 414/543

[56] References Cited

U.S. PATENT DOCUMENTS 3,658,189 4/1972 Brown et al. ..... 212/268

FOREIGN PATENT DOCUMENTS 410319 9/1968 Australia .

0079627 5/1983 European Pat. Off. .

0374775 6/1990 European Pat. Off. .

3413443 10/1985 Germany .

3806390 9/1989 Germany .

*Primary Examiner*—Margaret A. Focarino

*Assistant Examiner*—Thomas J. Brahan

*Attorney, Agent, or Firm*—Wenderoth, Lind & Ponack

[57] ABSTRACT

A multistage telescopic boom or jib, in particular for a loading crane on a truck, has hydraulic units each including a piston and a cylinder arranged between the successive, telescopically nested arms. A pipe projects axially from the bottom of the cylinder into the chamber of the cylinder, sealingly extending into the hollow piston rod when the piston is retracted and sealing the chamber of the cylinder from an inner chamber of the hollow piston rod. In order to ensure an automatic extension sequence of the telescopic arms, the inner chamber of each hollow piston rod is linked to the cylinder chamber of the next outer hydraulic unit by a preferably rigid line, and the inner chamber of each hollow piston rod communicates with the cylinder chamber of the same hydraulic unit when the piston is fully extended.

20 Claims, 6 Drawing Sheets

MULTISTAGE TTELESCOPE BOOM

This application is a continuation of now abandoned application, Ser. No. 08/081,293, filed as PCT/AT92/00144, Nov. 10, 1992.

BACKGROUND OF THE INVENTION

The invention relates to a multistage telescopic boom, in particular for a loading crane on a truck, where a hydraulic unit, comprising piston and cylinder, is arranged between each pair of successive, telescopic arms, where at least at the cylinder of an innermost arm a pipe extends axially from the cylinder bottom into the cylinder chamber. Such pipe reaches into a hollow interior of the piston rod so as to be sealed with respect to the piston when the piston is at least partially driven in. Thus, the cylinder chamber is sealed with respect to the interior of the hollow piston rod.

Sequence controls for loading cranes have the purpose of ensuring that the individual arms of a telescopic boom are telescoped or retracted in a specific, usually fixed order of sequence. The loading cranes used in the past by the company Palfinger Aktiengesellschaft are equipped with a mechanically simple sequence control of the above type, but which has, however, the drawback that only that arm of the telescopic boom that is braced directly against a folding arm enveloping such that arm is automatically telescoped first. The other arms of the telescopic boom (thrust arm) are, in contrast, not fixed with respect to the order of sequence in which they are telescoped. In the case of the cranes of Palfinger Aktiengesellschaft in prior public use, a valve which is actuated by means of a stop attached to the folding arm is on the piston side end of the hydraulic cylinder that actuates the first arm, such end being directed toward the folding arm. Not until this first arm is totally telescoped does the valve, designed as a non-return valve, allow the hydraulic fluid to flow through to the cylinders of the other telescope arms.

DE-A 34 13 443 shows a three stage telescopic boom with a controller to determine any arbitrary order of telescoping sequence. The hydraulic oil is fed into a central cylinder by way of a telescopic sliding line which is attached to a base cylinder and which is complicated and occupies a lot of space on the side next to the piston rod of the base cylinder. The hydraulic oil is fed into an outermost cylinder by way of a pipe which projects axially from the cylinder bottom and which extends so as to seal with respect to the piston into a hollow piston rod connected to the controller. The oil flowing out of the pipe of the base cylinder flows by way of a line into another pipe which projects from the bottom of the central cylinder and leads sealingly with respect to the piston in such cylinder into the hollow piston rod. The end of this hollow piston rod communicates with the cylinder chamber of the outermost hydraulic unit. In the device of DE-A 34 13 433 the order of sequence of the telescoping process is controlled exclusively by way of the external controller, which can control any arbitrary sequence of telescoping. Yet it is not ensured that the telescopic arms are telescoped automatically starting from the innermost arm. In addition, DE-A 34 13 443 does not teach how more than three hydraulic units are possible for a telescopic boom with more than three stages.

SUMMARY OF THE INVENTION

The object of the invention is to provide a constructively simple and compact device of the type described above in such a manner that it can be used to control automatically the sequence of movement of several telescopic arms.

This is achieved according to the invention in that the interior of each hollow piston rod of one hydraulic unit is connected by way of a preferably rigid line to the cylinder chamber of the next outer hydraulic unit when the piston of such one hydraulic unit is retracted, and that the interior of each hollow piston rod communicates with the cylinder chamber of the same one hydraulic unit when the piston of such one hydraulic unit is totally extended.

Whereas the pipe, which projects from the cylinder bottom of the device of DE-A 34 13 443 and extends into the hollow piston rod, serves merely for the passage of hydraulic oil to the next but one (third) hydraulic unit and, therefore, at each piston position communicates continuously exclusively with the interior of the hollow piston rod, a pipe of a hydraulic unit according to the invention is designed in such a manner that it and the position of the piston implements a control function for the supply of hydraulic oil into the next outer hydraulic unit. Whereas the cylinder chamber of the hydraulic unit is sealed with respect to the interior of the hollow piston rod, which is connected to the cylinder chamber of the next hydraulic unit when the piston is at least partially driven in, the interior of the hollow piston rod communicates with the cylinder chamber of the same hydraulic unit when the piston is driven totally out. Thus, it can be ensured that when hydraulic fluid is fed into the cylinder chamber of a hydraulic unit, the piston moves out, first of all, without any hydraulic oil continuing to flow into the next outer hydraulic unit. Not until the piston is totally driven out is there communication between the cylinder chamber and the interior of the hollow piston rod so that the hydraulic oil can continue to flow into the next outer hydraulic unit.

Such control effect of the pipe with respect to the supply of hydraulic oil, which depends on the position of the piston, into the next outer cylinder can be achieved in a simple manner, for example, by the pipe being shorter than the displacement path of the piston and thus, when the piston is driven totally out, issuing from the piston or a seal therein. By means of suitable inclined surfaces at the piston or at the free end of the pipe it can be achieved that the pipe enters, in fact, into the hollow piston rod when the piston is driven in again. To avoid problems with the pipe upon re-entering the piston when the piston is driven in, a preferred embodiment provides that the pipe is guided into the piston even when the piston is totally driven out and has near its free end at least one opening in the pipe wall or jacket. Such opening is positioned in the cylinder chamber when the piston is totally driven out and thus establishes communication between the cylinder chamber and the hollow piston rod through the end region of the pipe. In the retracted position of the piston, the closed pipe wall seals the interior of the hollow piston rod with respect to the cylinder chamber. When the piston is totally extended, however, the hydraulic oil can flow through the opening or boreholes provided near the free end of the pipe, into the pipe and from there into the interior of the hollow piston rod and finally into the cylinder chamber of the next outer hydraulic unit.

Except for the outermost hydraulic unit, which does not need any additional guidance of the hydraulic oil to the next outer hydraulic unit, all of the hydraulic units can be designed in essence identically and hydraulically connected in series. Without any complicated external controller, hydraulic oil has to be admitted only into the cylinder chamber of the innermost hydraulic unit in order to achieve successive telescoping of the hydraulic units. This "self-control" of the hydraulic units during extension ensures that an arm of the telescopic boom extends only after the next inner arm has already been telescoped.

Since the piston rod of a hydraulic unit and the cylinder of the next outer hydraulic unit are rigidly connected to the same arm of the telescopic boom, the line leading from the interior of the hollow piston rod into the cylinder chamber of the next outer hydraulic unit can be designed optimally as a wear-resistant and pressure-tight, rigid line.

To retract the arms of the telescopic boom in the correct sequence, all pistons can be loaded in the direction of retraction by feeding hydraulic oil into the annulus defined between the piston rod and the cylinder wall. A specified sequence of retraction can be achieved by opening valves in succession, which prevents the hydraulic oil from flowing out of the cylinder chamber. These "drain valves" can be controlled by the state of retraction of the next outer hydraulic unit. A preferred embodiment provides that the selected valves can also be preferably in the blocking direction openable non-return valves in the line leading from the hollow piston rod of the next inner hydraulic unit into the cylinder chamber. It is always possible to feed hydraulic oil through such a non-return valve in order to drive the piston out. If the piston is loaded in the retraction direction, this non-return valve blocks first. However, if the valve receives from a control line a signal that the next outer piston has already been driven in, then the non-return valve also opens in its original blocking direction and the hydraulic oil can flow out of the cylinder chamber over the line into the hollow piston rod of the next inner cylinder. From there the hydraulic oil flows over the pipe of the invention and from it into a drain line. This drain line can open in turn into a line leading to the interior of the hollow piston rod of the next inner hydraulic unit, from where the hydraulic oil can drain in turn by way of the pipe thereof. Thus, the pipes according to the invention are intended not only to control automatically the sequence frequency of the outward movements but also to recycle the hydraulic oil when the hydraulic units are retracted.

BRIEF DESCRIPTION OF THE DRAWINGS

Other advantages and details of the invention are explained below in the following description with reference to the accompanying drawings, wherein:

FIG. 4 is an axial sectional view of a hydraulic unit in a region of a cylinder boom when a piston is driven in.

DETAILED DESCRIPTION OF THE INVENTION

Figure 1:
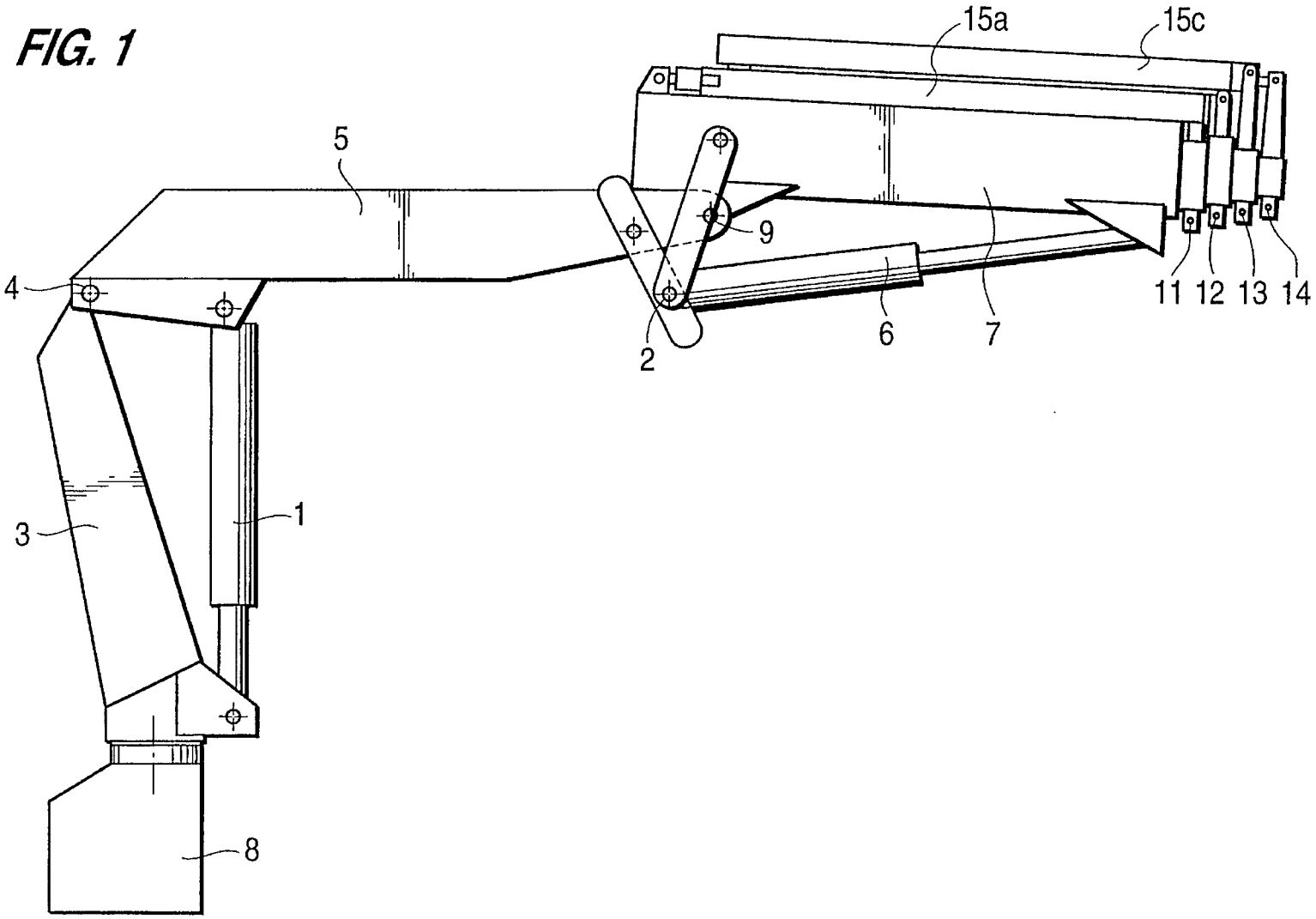
FIG. 1 is a diagrammatic view of a loading crane with a four stage telescopic boom or thrust arm.
Figure 1A:
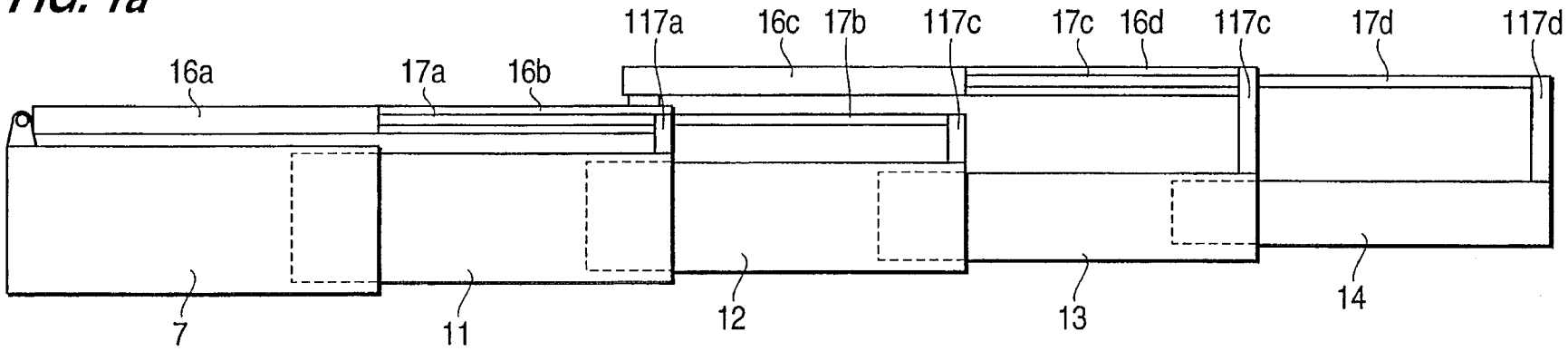
FIG. 1*a* is a view of the boom with the arms thereof fully extended.
Figure 1B:
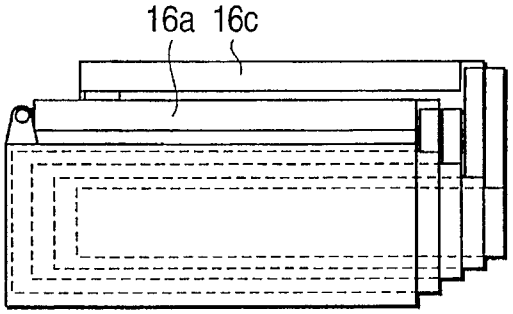
FIG. 1*b* is a view similar to FIG. 1*a* but with the arms fully retracted.

The loading crane, which is shown in FIGS. 1–1*b* and whose construction of arms corresponds to that of the state of the art, includes a stand 3 which can be pivoted about a vertical axis on a base 8. A lifting arm 5 is swivelled relative to stand 3 around a horizontal axis 4 by means of a lifting cylinder 1. A so-called folding base or innermost arm 7 is swivelled around another horizontal axis 9 by a hydraulic unit 6 and a toggle lever 2. The folding arm 7 forms with a series of telescopic arms 11–14, which altogether can be called a thrust arm, a four stage telescopic boom.

The invention relates to a sequence control to telescope and retract arms 11, 12, 13, 14, which are connected to the folding arm 7 or to each other by means of a series of four hydraulic units 15*a*–15*d* (in part not shown).

Figure 2:
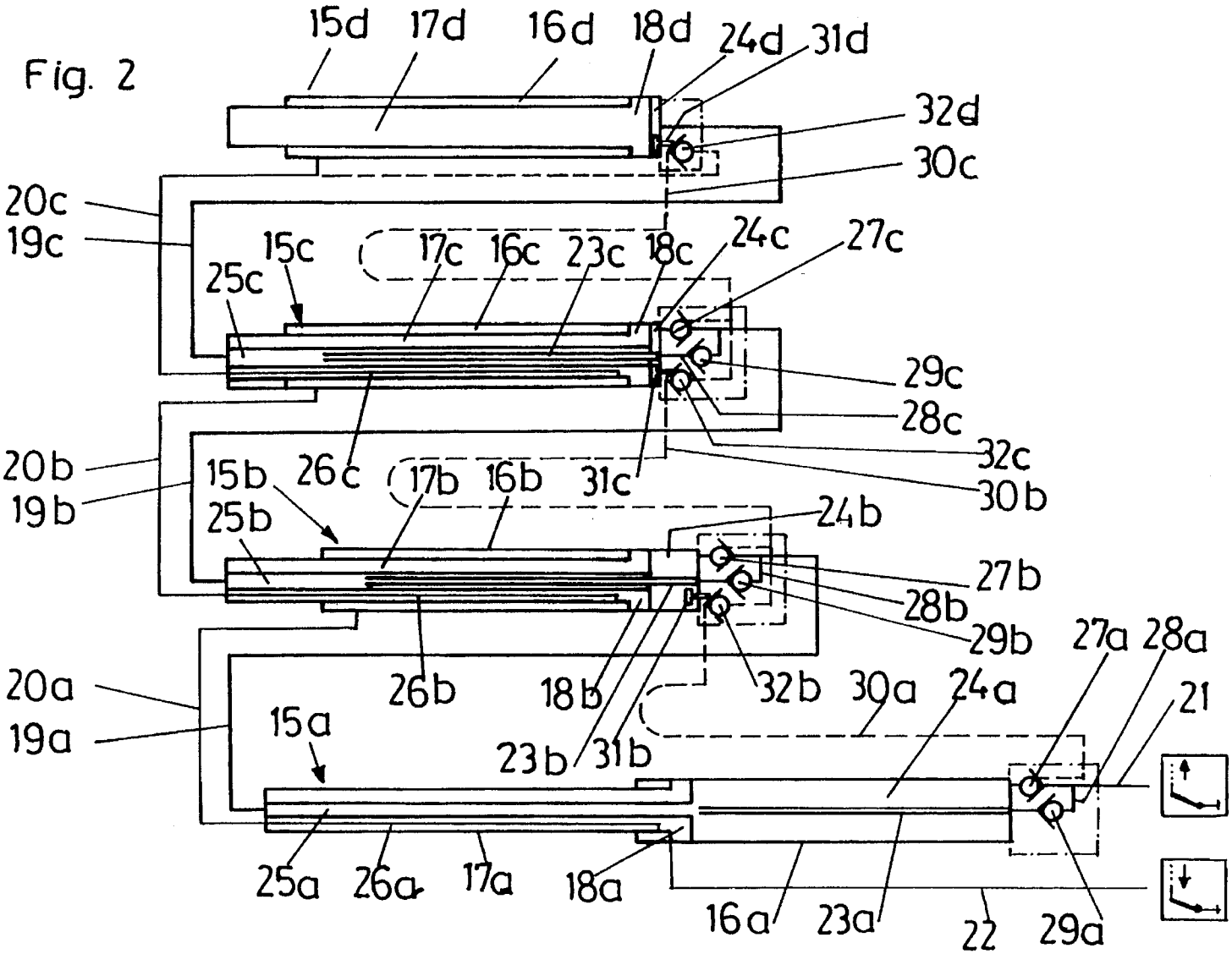
FIG. 2 is a fluid circuit diagram of a sequence control according to the invention with hydraulic control of a retraction sequence.

FIG. 2 shows a fluid circuit diagram of the hydraulic units 15*a*–15*d* for a multistage telescopic boom according to the invention. Each hydraulic unit includes a respective piston 18*a*–18*d* which can be caused to slide in a respective cylinder 16*a*–16*d* by a respective piston rod 17*a*–17*d* . The cylinder 16*a* could be connected, for example, to the folding arm 7 of FIG. 1, whereas the piston rod 17*a* can be connected with the arm 11, the piston rod 17*b* with the arm 12, the piston rod 17*c* with the arm 13, and the piston rod 17*d* with the arm 14. The cylinders 16*b*–16*d* of the three outer hydraulic units 15*b*–15*d* are rigidly connected, via respective arms 11–13, to the respective piston rods 17*a*–17*c* of the next inner hydraulic units 15*a*–15*c*, so that lines 19*a*–19*c*, 20*a*–20 *c* (to be explained in greater detail below) can be designed as rigid lines. Even an extension or telescoping line 21 and a retraction line 22 can be designed as rigid lines.

Respective pipes 23*a*–23*c* project axially from respective cylinder bottoms of the three inner hydraulic units 15*a*–15*c* into the respective cylinder chambers. When the respective piston 18*a*, 18*b*, 18*c* is at least partially retracted, the respective pipe 23*a*, 23*b*, 23*c* which is sealed with respect to such piston, extends into the respective hollow piston rod and thus seals the respective cylinder extension chamber 24*a*, 24*b*, 24*c* with respect to the interior or inner chamber 25*a*, 25*b*, 25*c* of the hollow piston rod 17*a*, 17*b*, 17*c*. Such seal, resting on the outside of the pipe in the region of the piston, is not shown in FIG. 2 but is visible in FIGS. 4 and 5 at 40.

In contrast to the state of the art, the pipe 23*a*–23*c* is designed according to the invention in such a manner that, when the piston is driven to its outermost position (e.g. as shown at piston 18*a* of the innermost hydraulic unit 15*a* in FIG. 2), the respective cylinder extension chamber 24*a* can communicate with the interior or inner chamber 25*a* of the piston rod 17*a* of the same hydraulic unit. The pipe 23*a* is shorter than the displacement path of the piston 18*a*. Thus, when piston 18*a* is driven to its outermost position, the pipe 23*a* and the seal thereof are totally withdrawn from the piston and the seal therein. Accordingly, hydraulic oil fed by way of extension line 21 flows out of the cylinder chamber 24*a* into the interior chamber 25*a* of the piston rod 17*a*. At this stage, according to the invention, interior or inner chamber 25*a* is connected by way of a preferably rigid line 19*a* to the cylinder extension chamber 24*b* of the next outer hydraulic unit 15*b*. Thus, when the pressurized hydraulic oil is admitted to the extension line 21, at first only the piston 18*a* and piston rod 17*a* and thus the next outermost arm 11 of the boom are telescoped from innermost arm 7. Not until the piston 18*a* has reached the final position shown in FIG. 2 does hydraulic oil flow into the next outer hydraulic unit 15*b* and displaces the piston 18*b* and piston rod 17*b* thereof outwardly. In FIG. 2 the piston 18*b* is already partially driven out, whereas the pistons of the two outer hydraulic units 15*c* and 15*d* are shown still totally retracted.

Altogether the result of constructing the hydraulic units 15*a*–15*c* virtually identically without additional external controllers is an automatic sequence control, during which process a next outer piston rod is not driven out until the next inner piston rod has already been totally driven out.

Hydraulic retraction lines 22, 20*a*–20 *c*, which communicate among each other continuously, are provided for the retraction of the piston rods 17*a*–17*d* . Each of these lines open into a respective annulus or retraction chamber defined between the respective piston rod 17*a*–17*d* and cylinder wall, and in particular on the side of the driven-out piston 18*a*–18*d* that faces away from the piston head. Each of respective lines 26*a*–26*c*, each of which is separated from the interior 25*a*–25*c* of the piston rod and is led through the piston rod 17*a*–17*c* from the region of the piston and which opens into a hydraulic retraction line 20*a*–20 *c* to the next outer hydraulic unit, is provided from this respective annulus. When pressurized hydraulic oil is admitted to the hydraulic retraction line 22, all of the pistons 18*a*–18*d* are loaded first of all in the direction of retraction. Then the piston 18*a* can be retracted only a minimum distance, until the pipe 23*a* seals the cylinder chamber 24*a*. Then a non-return valve 27*a* blocks the piston 18*a* from retracting further. Even the pistons 18*b* and 18*c* can be driven inwardly only a minimum distance, until the pipe 23*b* or 23*c* seals the cylinder chamber 24*b* or 24*c*. Due to the non-return valve 27*b* or 27*c* that is closed beforehand, the hydraulic oil cannot drain anywhere from the cylinder extension chambers 24*b* and 24*c*, and the pistons 18*b* and 18*c* cannot be driven inwardly any further. Only the outermost piston 18*d* can be driven inwardly without hindrance from the beginning, since nothing prevents the hydraulic oil draining from the cylinder chamber 24*d*. The hydraulic oil drains, first of all, through the line 19*c*, the piston rod interior chamber 25*c* and the pipe 23*c*, to which a drain line 28*c* is attached. A second non-return valve 29*c* is arranged in this drain line, and the drain line 28*c* opens into line 19*b* at a position on a side of the first non-return valve 27*c* away from the cylinder chamber. When the piston 18*c* is driven out, the second non-return valve 29*c* prevents the hydraulic oil from penetrating into the pipe 23*c*, but allows the hydraulic oil to drain without hindrance from pipe 23*c*. Such hydraulic oil flows from the line 19*b* through the hydraulic units 15*b* and 15*a* in an analogous manner.

After the outermost piston rod 17*d* has been totally driven inwardly to a retracted position of piston 18*d*, the piston 18*d* opens by way of an actuating pin 31*d* a non-return valve 32*d*, which previously was blocked, disposed in a control line 30*c* and representing in essence a mechanism to detect the totally retracted position of the piston 18*d*. At this stage, hydraulic oil flows by way of the control line 30*c* to the next inside hydraulic unit 15*c* and opens the non-return valve 27*c*. Thus, the hydraulic oil in the cylinder extension chamber 24*c* can drain along a path analogous to that described above, and the piston 18*c* and piston rod 17*c* are driven inwardly. The totally retracted piston 18*c* then opens a non-return valve 32*c* by way of an actuating pin 31*c*, resulting in hydraulic oil flowing to the hydraulic unit 15*b* by way of a control line 30*b*. There the same control procedures as for the hydraulic unit 15*c* are carried out. Finally, hydraulic oil flows into a line 30*a* and opens the first non-return valve 27*a*, and thus the innermost piston rod 17*a* can also be driven inwardly.

It is clear that the mechanism to detect the totally retracted position of a piston can also detect the position of the arm of the telescopic boom that is moved by the corresponding piston rod. A control pulse also can be derived from the position of the telescopic arm as soon as it is totally retracted.

Figure 3:
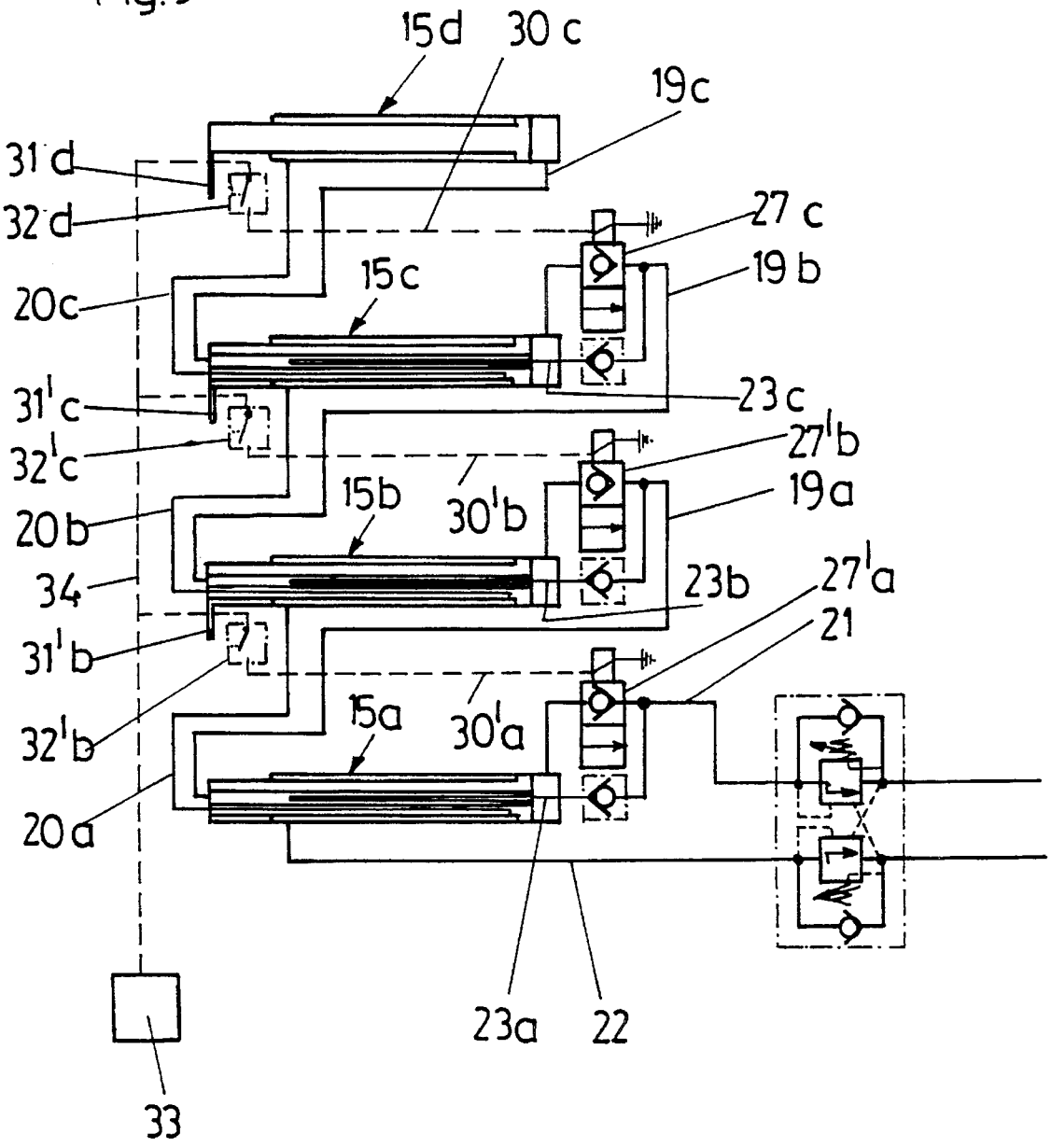
FIG. 3 is a fluid circuit diagram of a sequence controller according to the invention with an electric control of the retraction sequence.

The embodiment shown in FIG. 3 differs from the embodiment shown in FIG. 2 in essence by the first non-return valves 27'*a*–27'*c* for controlling the retraction sequence being electrically actuated. Otherwise, the hydraulic units are built in essence identically as in the case of the embodiment shown in FIG. 2. The pipes 23*a*–23*c* are shown in FIG. 3 only by solid lines but in reality they are just as hollow as the pipes shown in FIGS. 2 or 4 and 5.

To retract the piston rods and thus the arms of the boom, the hydraulic line 22 is put under pressure. Thus, the piston of the outermost hydraulic unit 15*d* retracts first. When the piston 18*d* is totally driven inwardly, a stop 31'*d* attached to the piston rod or to the suitable arm of the boom closes a switching element 32'*d*, thus resulting in current being supplied from a current source 33 by way of an electrical line 34 to a line 30'*c* leading to electrically openable non-return valve 27'*c*. Thus, when the piston of unit 15*d* is totally driven in, the outermost hydraulic unit 15*d* opens the valve 27'*c* and thus allows hydraulic oil to drain from the cylinder chamber of the hydraulic unit 15*c*, whereupon the piston and piston rod thereof retract. In an analogous manner a stop 31'*c* and a switching element 32'*c* switch by way of a line 30'*b* electrically operated non-return valve 27'*b*, and a stop 31'*b* with a switching element 32'*b* switch by way of an electric control line 30'*a* electromagnetically actuated non-return valve 27'*a*. Thus, altogether the retraction sequence is automatically fixed.

Instead of the mechanically operated switching elements 32'*b*–32'*d*, proximity switching elements can be provided, for example, magnetically operated reed switches or switches operated by way of light barriers or similarly switched switching elements.

Figure 4:
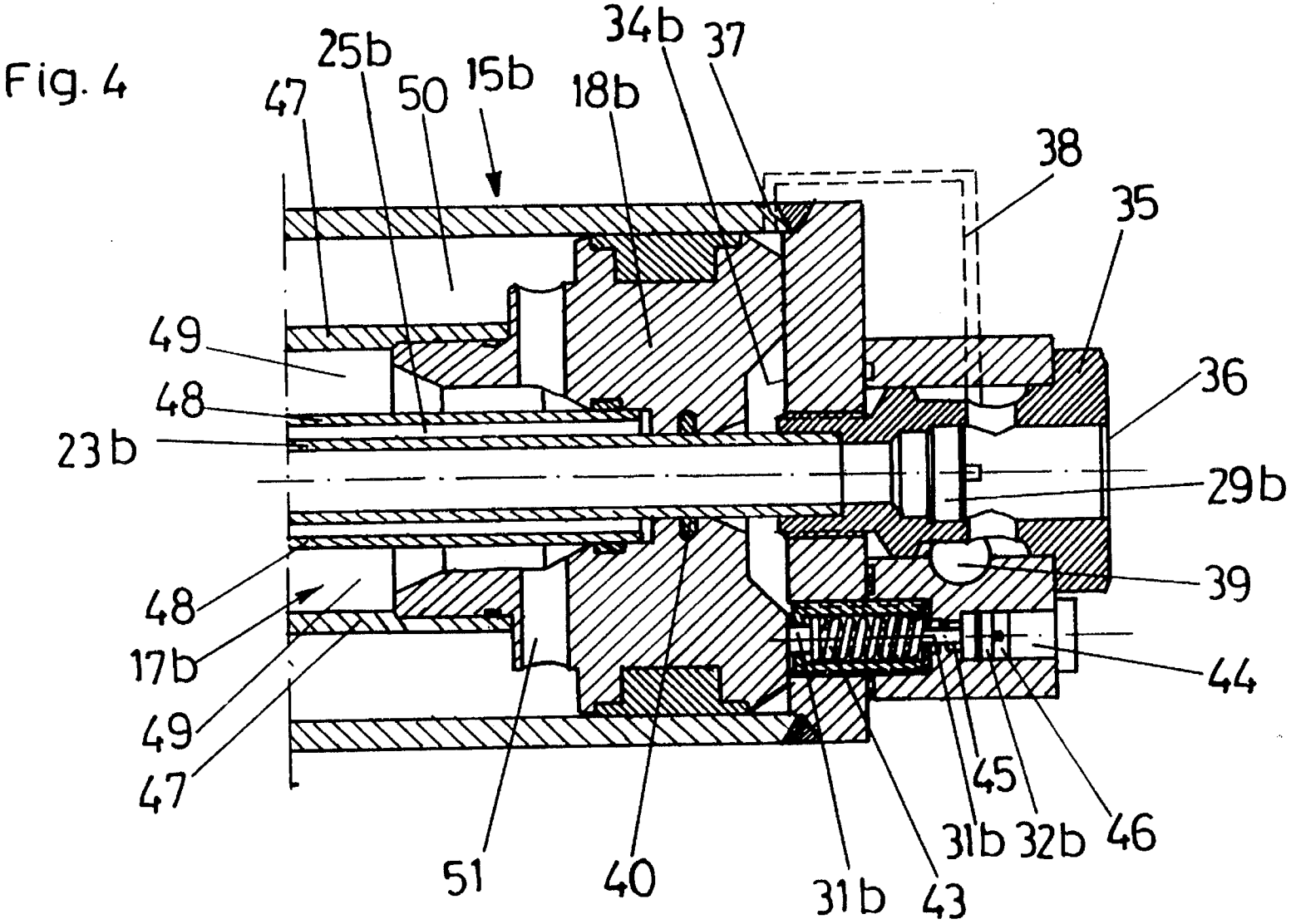

FIG. 4 is a longitudinal sectional view of hydraulic unit 15*b* in the region of a cylinder bottom 34*b* with the piston 18*b* totally driven in. The pipe 23*b* is mounted, e.g. by being threaded into a hollow screw 35, on bottom 34 and projects in the axial direction from the cylinder bottom 34*b* into the cylinder chamber. The non-return valve 29*b* allows the hydraulic oil to drain without hindrance from the pipe 23*b* into the line to be attached at 36. The hydraulic oil for driving out the piston 18*b* is supplied through an opening 37 and line segment 38, which is shown by dashed lines and to which hydraulic oil can be supplied by way of a non-return valve (which corresponds to the first non-return valve 27*b* of FIG. 2 or 27'*b* of FIG. 3 and which is not shown in detail) at a position 39. Since the pipe 23*b* is sealed with respect to the piston 18*b* by means of seal 40, the piston moves out when the hydraulic oil is supplied through opening 37, without any hydraulic oil subsequently flowing into the interior or inner chamber 25*b* of the hollow piston 17*b*.

Figure 5:
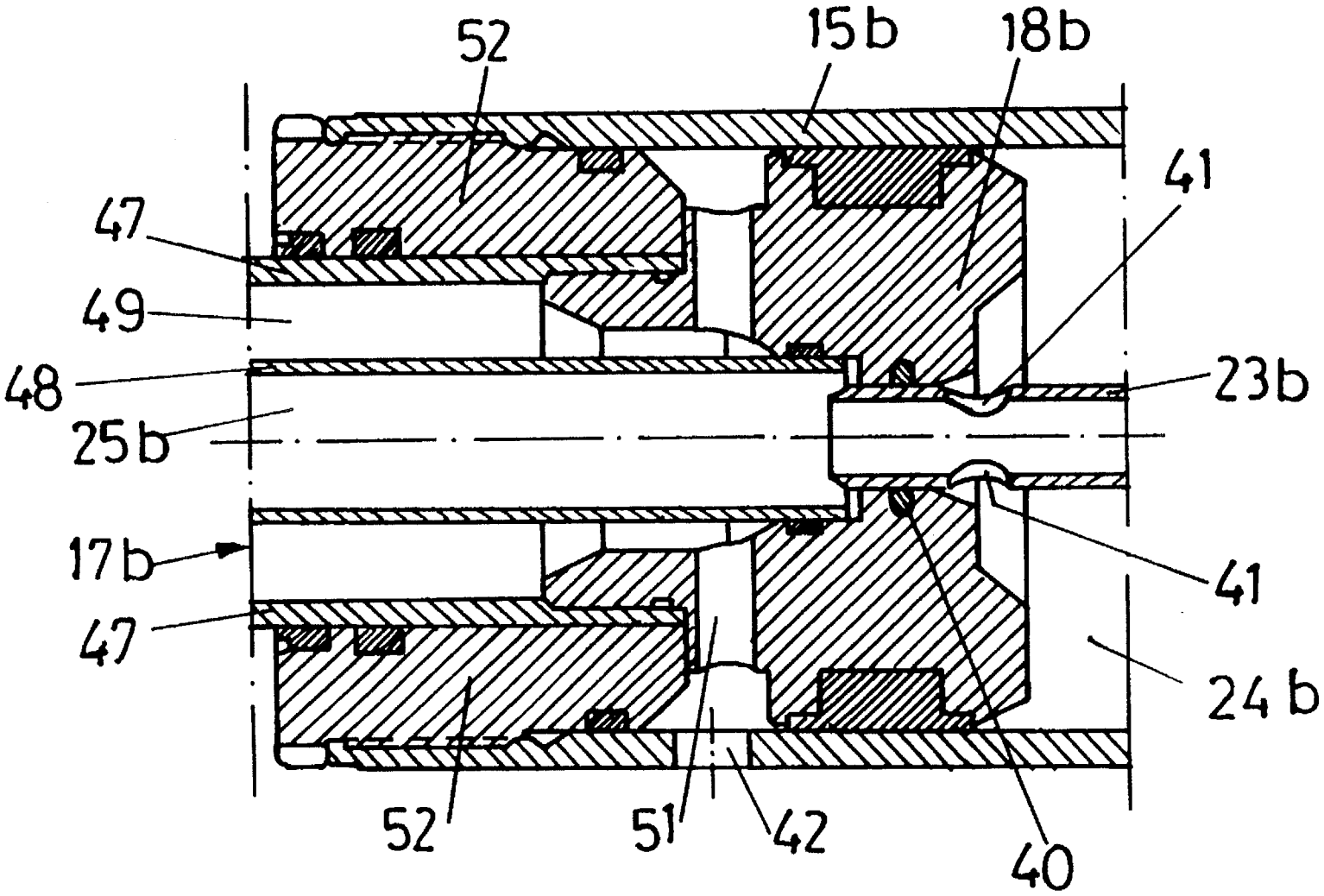
FIG. 5 is an axial sectional view in the region of the piston with the piston driven totally out.

Not until the piston 18*b* has reached the totally extended position shown in FIG. 5 (contact at a cylinder end segment 52) can the hydraulic oil flow from the cylinder extension chamber 24*b* by way of the boreholes 41, provided in the vicinity of the free end of the wall of the pipe 23*b*, into the interior or inner chamber 25*b* of the hollow piston rod 17*b*. From there the oil can then flow over a line 19*b* (illustrated in FIG. 2) into the cylinder extension chamber of the next outer hydraulic unit and drive it outwardly.

To retract the piston 18*b*, hydraulic oil is supplied from a line (not illustrated) and an opening 42 into the annulus or retraction chamber provided between the piston rod 17*b* and the cylinder surface. Thus, in every case the piston 18*b* moves first slightly inwardly until the boreholes 41 in the pipe 23*b* are closed by piston 18*b*. Up to that point, hydraulic fluid can drain from the cylinder chamber 24*b* and the openings 41 by way of the pipe 23*b*. After this short movement of the piston 18*b*, it remains stationary because now the cylinder chamber 24*b* is sealed with respect to the interior of the pipe 23*b* and no hydraulic oil can drain for the time being. If at this stage the non-return valve at the position 39 opens after the next outer hydraulic unit is totally driven in, the hydraulic oil can flow from the line 38 out of the cylinder chamber 24*b*, and the piston 18*b* can move into the position shown in FIG. 4. There the piston 18*b* presses the actuating pin 31*b* counter to the action of a spring 43 to the right as shown in FIG. 4 and thus opens the non-return valve 32*b*, which is installed in a borehole closed by a screw 44. Thus, hydraulic oil can flow counter to the original blocking direction of the non-return valve 32*b* from the control line (which is not illustrated but corresponds to the control line 30*b* of FIG. 2) which is attached to a chamber 46 into a control line (which is not illustrated but corresponds to the control line 30*a* of FIG. 2) which is attached to a chamber 45, and thus can open the first non-return valve of the next inner hydraulic unit, resulting in such hydraulic unit retracting.

In the embodiment shown in FIGS. 4 and 5 the piston rod 17*b* is designed as a double pipe including an interior pipe 48 lying concentric to an outer pipe 47 and enveloping the interior or inner chamber 25*b* of the piston rod 17*b*. An annulus 49 between the outer pipe 47 and the inner 48 pipe makes available a line (corresponding to the line 26*b* of FIG. 2) that is hydraulically separated from the interior 25*b* in the piston rod, in order to guide hydraulic oil from cylinder interior or retraction chamber 50 by way of an opening 51 through the piston rod annulus 49 out of the piston rod and from there into the cylinder annulus or retraction of the next outer hydraulic unit.

It is self-evident that the invention is not restricted to the embodiments shown. For example, any number other than the illustrated four hydraulic units can also be connected together in series.

I claim:

1. A multistage telescopic boom comprising:

a plurality of arms including a non-telescoping longitudinally innermost arm and plural, successively longitudinally outer arms each telescopingly nested within a respective precedingly inner arm and successively movable longitudinally thereof;

plural hydraulic units connecting respective pairs of adjacent said arms, each said hydraulic unit achieving telescopic movement of an outer said arm of the respective pair of arms relative to an inner said arm thereof;

each said hydraulic unit comprising a cylinder rigidly mounted on said inner arm of the respective said pair of arms, a piston slidable within an interior of said cylinder and dividing said interior into extension and retraction chambers receiving hydraulic fluid, and a piston rod fixed to said piston and fixed to said outer arm of said respective pair of arms, such that said piston rod and said outer arm are movable with said piston relative to said cylinder and said inner arm;

said piston and piston rod of at least an innermost said hydraulic unit being hollow and having an inner chamber, and said cylinder of said at least said innermost hydraulic unit having mounted on a bottom wall thereof a pipe extending into said extension chamber thereof, said pipe sealingly fitting within said inner chamber and preventing communication between said extension chamber and said inner chamber when said piston and piston rod are only partially extended relative to said cylinder, and said extension chamber and said inner chamber being in communication when said piston and piston rod are fully extended relative to said cylinder, thereby enabling hydraulic fluid to pass from said extension chamber to said inner chamber; and a fluid line connecting said inner chamber of said piston and piston rod of said at least said innermost hydraulic unit to said extension chamber of said cylinder of the next outer said hydraulic unit;

whereby hydraulic fluid can be passed to said extension chamber of said next outer hydraulic unit only after said piston and piston rod of said innermost hydraulic unit have fully extended the next outer said arm relative to said innermost arm.

2. A multistage telescopic boom as claimed in claim 1, wherein said fluid line comprises a rigid line.

3. A multistage telescopic boom as claimed in claim 1, wherein said pipe is shorter than a path of displacement of said piston within said cylinder, such that when said piston and piston rod are fully extended relative to said cylinder said pipe is fully withdrawn from said inner chamber, thereby enabling fluid to pass from said extension chamber to said inner chamber.

4. A multistage telescopic boom as claimed in claim 1, wherein said pipe has a length to fit within said inner chamber when said piston and piston rod are fully extended relative to said cylinder, and said pipe has adjacent a free end thereof at least one opening open to said extension chamber when said piston and piston rod are fully extended relative to said cylinder and blocked from said extension chamber in all other positions of said piston and piston rod relative to said cylinder.

5. A multistage telescopic boom as claimed in claim 1, wherein all of said hydraulic units except an outermost hydraulic unit are of identical construction.

6. A multistage telescopic boom as claimed in claim 1, further comprising an extension line for supply of hydraulic fluid to said extension chamber of said innermost hydraulic unit.

7. A multistage telescopic boom as claimed in claim 6, wherein said extension line comprises a rigid line.

8. A multistage telescopic boom as claimed in claim 6, wherein said fluid line and extension line open into the respective said extension chambers adjacent said bottom walls thereof.

9. A multistage telescopic boom as claimed in claim 8, wherein said extension line and said fluid line each have therein a first non-return valve to prevent fluid to pass thereto from the respective said extension chamber.

10. A multistage telescopic boom as claimed in claim 9, wherein each said hydraulic unit except said innermost hydraulic unit includes a detector to detect a fully retracted position of the respective said piston or arm connected thereto and to open a valve of the next inner said hydraulic unit and allow fluid flow from said extension chamber of said each hydraulic unit to said retraction chamber of said next inner hydraulic unit.

11. A multistage telescopic boom as claimed in claim 10, wherein said valve comprises said first non-return valve.

12. A multistage telescopic boom as claimed in claim 11, wherein said detector opens said first non-return valve by way of a control line.

13. A multistage telescopic boom as claimed in claim 12, wherein said control line comprises a fluid line, and said detector comprises a hydraulic control valve connected to said control line and openable by said piston or arm connected thereto to allow fluid flow through said control valve to open said first non-return valve.

14. A multistage telescopic boom as claimed in claim 12, wherein said first non-return valve comprises an electromagnetically operated valve, said control line comprises an electric line connected to said valve, and said detector comprises a switch operable by said piston or arm connected thereto to send a signal through said electric line to open said valve.

15. A multistage telescopic boom as claimed in claim 9, further comprising a drain line connected to each said pipe at an end thereof at the respective said cylinder bottom wall.

16. A multistage telescopic boom as claimed in claim 15, wherein each said drain line has therein a respective said second non-return line allowing fluid flow from said pipe and connected to the respective said first non-return valve at a side thereof opposite the respective said extension chamber.

17. A multistage telescopic boom as claimed in claim 1, further comprising respective retraction lines extending from said retraction chambers of said hydraulic units, said retraction lines except for said retraction line of said innermost hydraulic unit connecting with said retraction chamber of the next inner said hydraulic unit.

18. A multistage telescopic boom as claimed in claim 17, wherein said retraction lines comprise rigid lines.

19. A multistage telescopic boom as claimed in claim 17, further comprising, for each said hydraulic unit except the outermost said hydraulic unit, a connecting line leading from the respective said retraction chamber through the respective said piston rod, separate from said inner chamber thereof, and connected to the respective said retraction line leading to the next outer said hydraulic unit.

20. A multistage telescopic boom as claimed in claim 19, wherein each said piston rod, other than that of said outermost hydraulic unit, has a double pipe configuration formed of inner and outer concentric pipes defining therebetween an annular chamber constituting said connecting line.

* * * * *